US006481082B1

(12) United States Patent
Widney et al.

(10) Patent No.: US 6,481,082 B1
(45) Date of Patent: Nov. 19, 2002

(54) PORTABLE CONTINUOUS SUCKER ROD MANUFACTURING PROCESS

(75) Inventors: Scott W. Widney, New Sarepta (CA); Richard L. Dedels, Edmonton (CA)

(73) Assignee: 768885 Alberta Ltd., New Sarepta (CA)

( * ) Notice: Subject to any disclaimer, the term of this patent is extended or adjusted under 35 U.S.C. 154(b) by 89 days.

(21) Appl. No.: 09/649,098

(22) Filed: Aug. 28, 2000

(51) Int. Cl.[7] ..... B23Q 17/00
(52) U.S. Cl. ..... 29/407.01; 29/460
(58) Field of Search ..... 29/407.01, 460; 219/137 R

(56) References Cited

U.S. PATENT DOCUMENTS 3,769,836 A * 11/1973 Heldenbrand
3,923,469 A 12/1975 Palynchuk
4,945,938 A * 8/1990 Ponsford et al.
5,088,638 A * 2/1992 Karaev et al.
5,172,591 A * 12/1992 Bohon
5,572,783 A * 11/1996 Wacker
5,873,157 A * 2/1999 Hart et al.
6,202,863 B1 * 3/2001 Grenier
6,212,763 B1 * 4/2001 Newman

FOREIGN PATENT DOCUMENTS

CA 942585 2/1974

* cited by examiner

*Primary Examiner*—David P. Bryant
(74) *Attorney, Agent, or Firm*—Anthony R. Lambert

(57) ABSTRACT

Sucker rod is made at a well site by welding 40 foot lengths of straight round bar. The welded rod is then coiled on large radius coils at the well site. Round bar is prepared for welding by pencil pointing and then mig welded. The coils are large enough that the bending stress of the rod is not exceeded.

15 Claims, 4 Drawing Sheets

PORTABLE CONTINUOUS SUCKER ROD MANUFACTURING PROCESS

FIELD OF THE INVENTION

This process relates to a new apparatus and process for manufacturing continuous sucker rod.

BACKGROUND OF THE INVENTION

A sucker rod string is the "drive shaft" for powering a down hole pump. At the top end of this drive shaft there is usually an electric motor drive and at the bottom end there is a pump. There are two kinds of pumps used for pumping oil from wells: reciprocating piston pumps and rotary progressive cavity pumps.

Both styles of pump require a similar drive shaft. In order to have sufficient strength this rod string usually requires a tensile strength of 110 ksi , which corresponds to a Rockwell hardness value in the neighborhood of 26 HRc. Rod manufacturers like to use this hardness as a maximum because $H_2S$ corrosion rates typically accelerate at hardness values above this value. Heat treating the steel to attain the desired hardness is part of the present day process for producing continuous sucker rod.

Continuous sucker rod strings originally were all rolled to a semi elliptical shape. The reason for using the elliptical shape is to eliminate excessive bending stresses in the rod string when it is compressed into a storage reel that is only 18 feet in diameter. Round rod produces much higher bending stresses when stored in similar reels.

Today round rod is a necessary component to meet the high torsional needs of progressing cavity pumps. In fact the majority of continuous rod produced today is of round cross section and the demand for larger and larger round sections is increasing.

Existing manufacturing of continuous rod begins with the purchase of soft steel coils from steel mills. Coil lengths are typically 1500 feet long, and are wound like garden hose to an inside diameter of 36" and an outside diameter of 42". The coil weighs approximately 4500 lbs. The rod diameter is typically ¾", ⅞" or 1" in diameter. FIG. 1*a* and FIG. 1*b* depict an existing transport trailer 10 carrying 18 foot reel 12 that are presently used for transporting finished rod from the manufacturing plant to the customer's well site. The trailer 10 and reel 12 have dimensions of about 12 foot by 15 foot that define the travelling space required while the trailer is going down the highway. These particular limits are at their maximum. The reel is too small for storing rod without bending it but the road constraints do not allow for anything else.

FIG. 2 denotes a flow diagram for the existing method of manufacture. Once coils reach the manufacturing plant the following process takes place 21. Uncoiling raw material on a mandrel
22. Straightening raw material
23. Flash butt welding uncoiled individual coils together end for end
24. Descaling and cleaning raw material by shot blasting
25. Driving and tensioning raw material
26. Heat treating raw material to the austenizing temperature of the steel used
27. Rolling and stretching material to shape and size
28. Water quenching material
29. Tempering material to a desired steel hardness
30. Quenching material 31. Coating material with a rust inhibitor
32. Loading material on to a transport trailer for shipping to the customers location.

The transport spools are built as large as possible but built to suit the legal dimensional limitations of the motor vehicle regulations in Canada. The actual spool diameter for rod storage is 18 feet. When 1" diameter sucker rod is put in one of these spools it is stressed to the limit. The rod is actually bent permanently as the surface bending stresses can be as high as 138 ksi.

SUMMARY OF THE INVENTION

This invention overcomes the problem of rod bending and coil transportation. Rather than make this sucker rod product and then ship it to the well site on a transport reel, this invention proposes, in one aspect, making the product at the well site using simple equipment. The invention thus provides a portable method for manufacturing continuous sucker rod at any given location that the customer wants the product unloaded and ready for use.

Use of a portable method of manufacturing continuous sucker rod means that the rod can be made at any location that the customer chooses. Therefore the plant facility is forever moving and hence the definition—"portable". The reason that present plants cannot be portable is twofold: Heat treating equipment requires too much power to be portable and available at any given location. Remote power for flash butt welding is also difficult to find at any given location. Flash butt welding is presently done in the field to repair existing rod strings if they break. This welding process is battery powered and allows for one or two welds without having to recharge.

The process of the present invention does not require heat treating the rod. The raw material is heat treated by the manufacturer and already has the physical properties that are required in the finished product. The reason the existing process includes heat treating after joining lengths is to eliminate heat affected zones produced by welding. The difficulty with this is that all the welds can not be heat treated in such a fashion because the very end connection must be made in the field. Sometimes both rod ends are welded in the field and these welds are left with heat affected zones. Heat affected zones are areas beside the joint that are softer than the parent material once the weld has cooled down. Along with being softer the rod strength in this particular area is decreased in proportion.

Therefore, according to an aspect of the invention there is provided a method of preparing rod for injection into a well, the method comprising the steps of: welding straight lengths of round bar end to end to form welded rod; and coiling the welded rod on a storage reel at a well site. By welding straight lengths of round bar together to make a rod, the process may be conveniently carried out at a well site.

Further aspects of the invention include: transporting straight lets of round bar to the well site, preparing the straight lengths of round bar for welding at the well site, preferably by pencil pointing the ends of the lengths of round bar, with the welding being carried out by MIG welding, grinding and polishing the welded rod, torque testing the welded rod, and coating the welded rod with a rust inhibitor after grinding and polishing. Each length of round bar may be about 40 feet long.

Advantages of the invention include: The plant is totally mobile and the product is made at ever changing well sites. Short bar lengths are welded together instead of long coils being welded together. The welding method is mig welding and not flash butt welding. The welds are not post heat treated and don't have to be. Transport trailers are not required to transfer finished product as product is made on site.

BRIEF DESCRIPTION OF THE DRAWINGS

There will now be described preferred embodiments of the invention, with is reference to the drawings, by way of illustration only and not with the intention of limiting the scope of the invention, in which.

DETAILED DESCRIPTION OF PREFERRED EMBODIMENTS

Figure 1A:
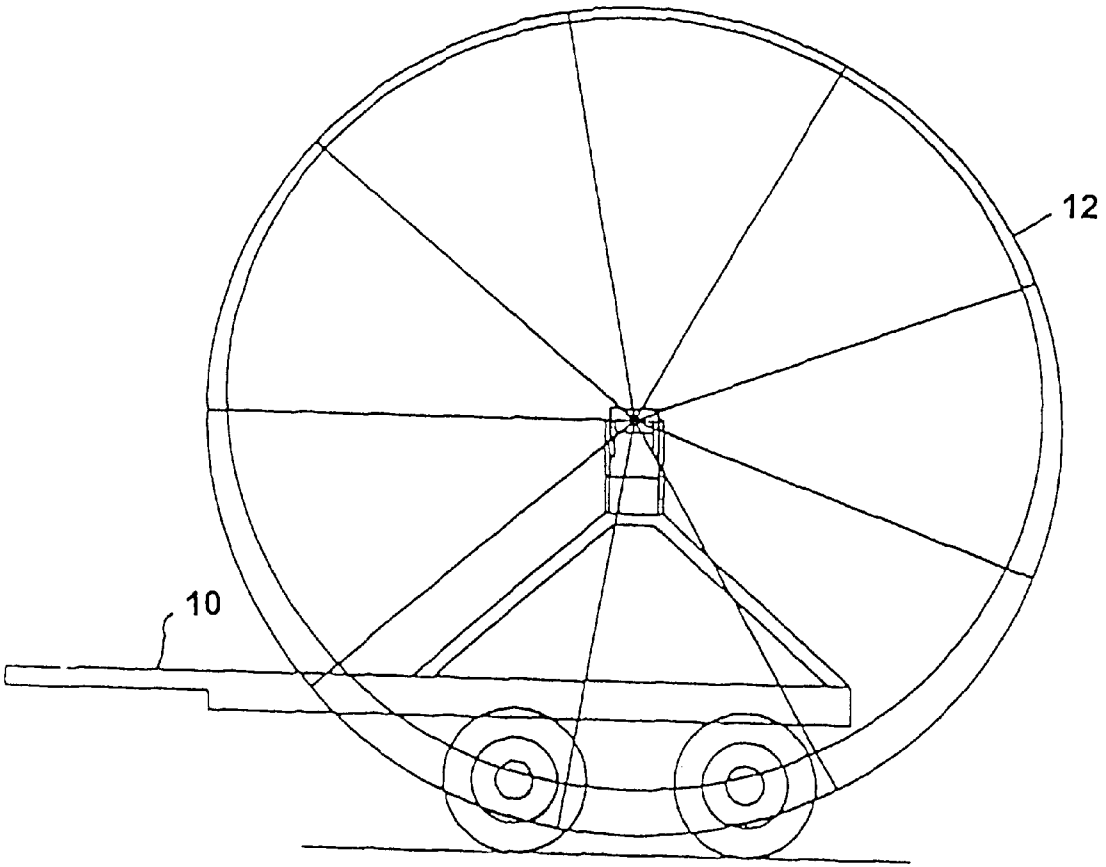
FIG. 1A (PRIOR ART)
FIG. 1*a* is a front view of an existing transport trailer and FIG. 1*b* is an end view of the same transport trailer.
Figure 1B:
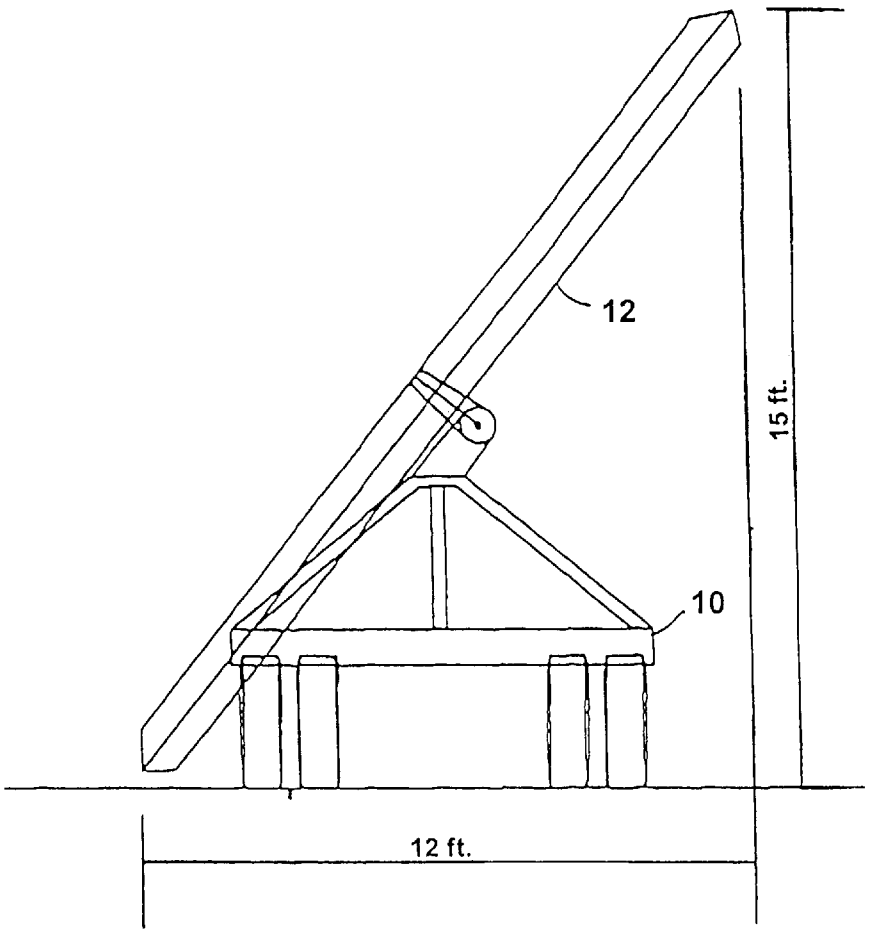
FIG. 1B (PRIOR ART)
Figure 2:
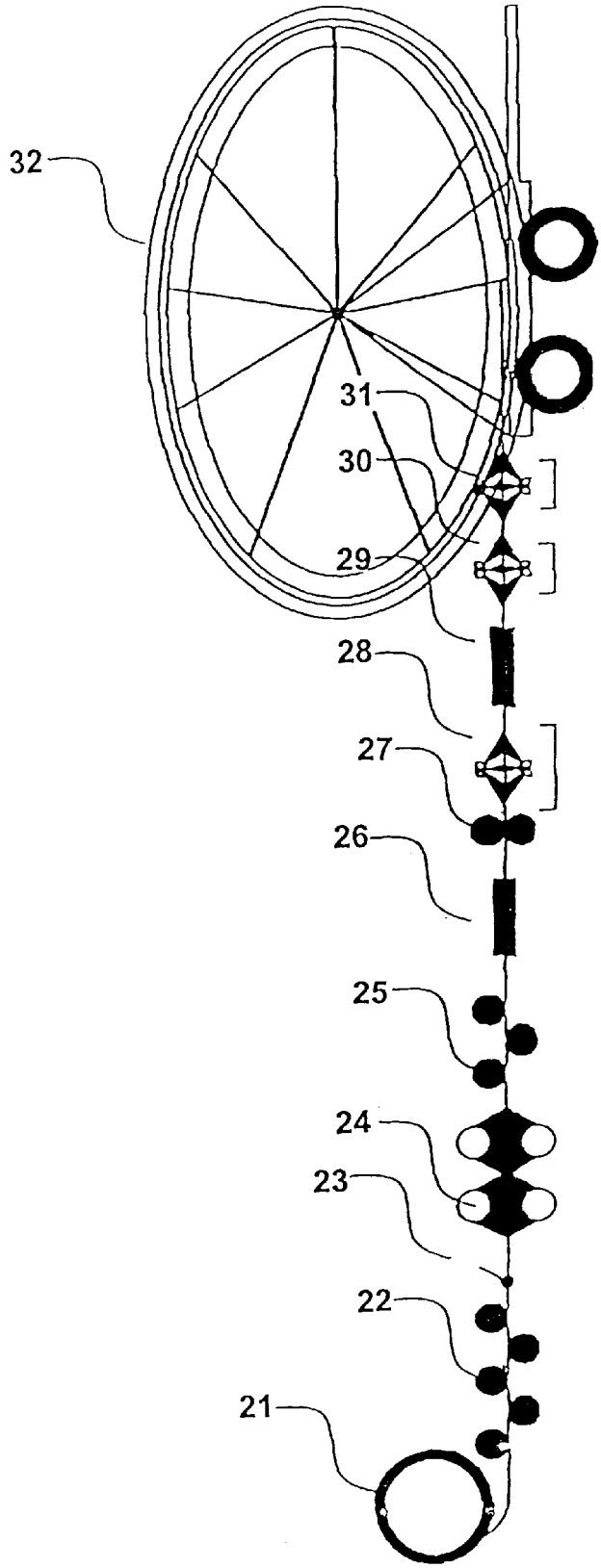
FIG. 2 (PRIOR ART)
FIG. 2 is a flow diagram for the process presently used for making and delivering continuous rod to the customers well site.
Figure 3:
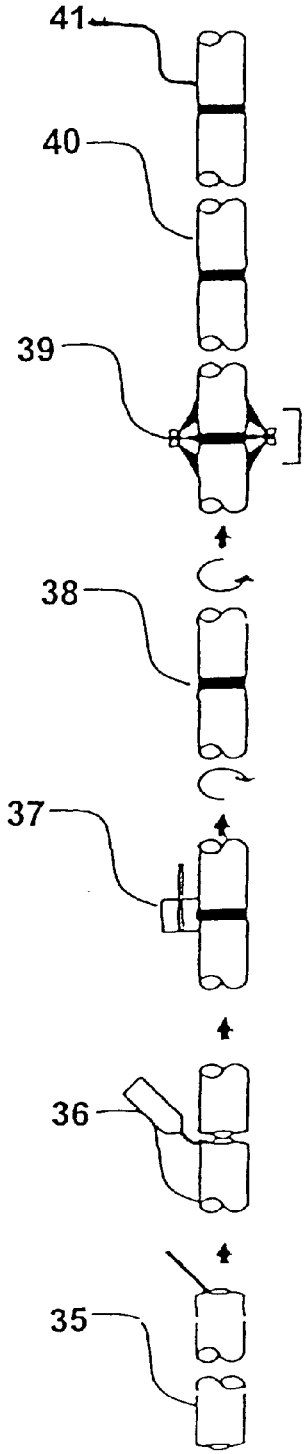
FIG. 3 is a flow diagram for an embodiment of the process of the invention.

FIG. 3 illustrates the method steps involved in a preferred embodiment of the invention. First, 40 foot lengths of straight heat treated round bar are purchased from a steel mill. The round bar should made of steel suited for use as sucker rod. The rod usually requires a tensile strength of 110 ksi, which corresponds to a Rockwell hardness value in the neighborhood of 26 HRc. The rod diameter is typically ¾", ⅞" or 1" in diameter. Next, the round bar is loaded on a mobile container that is equipped to join the 40 foot lengths. The equipment required includes: pencil pointing equipment, clamping and aligning equipment, a mig welding unit that may be moved around a joint (such as used on exhaust assemblies) and grinding and polishing equipment. All of this equipment is commercially available, except the mig welding unit will require a slight modification, well within the skill of a person skilled in the art, to enable it to make a 365 degree turn around the round rod and back again. The bar is then transported in the container to a customer's well site.

At the well site, these steps take place:

35. Prepare the bar ends for welding. This is a pencil pointing operation. Pencil pointing is a conventional process for preparing bar for welding.
36. Clamp and align two bars, end for end, for welding. Clamping and aligning of bars is also known.
37. Mig weld the bar ends together. The required path (around the rod and back again) and speed for the mig wire is computer controlled in accordance with known techniques applied as disclosed here in a novel manner.
38. Grind and polish the weld joint in accordance with conventional techniques.
39. Consecutive welds are made until the string length that the customer wants is complete.
40. Non destructive testing of the welded joints is an optional procedure at this point. For example, the rod might be clamped on either side of a weld and an axial twist applied to approximately 85% of the yield strength of the material.
41. Coat the rod with a rust inhibitor in conventional manner.

The rod is then stored at the well site on a single coil until the customer wants the rod installed in the well. Storage reels are large enough to prevent rod bending. This may be ensured by referring to the formula for bending stress. That formula is: S=E * r/R, where S=the bending stress on the surface of the rod, E=the modulus of elasticity of steel=30,000,000 psi, r=the radius of the rod, and R=the radius of the storage reel. R should not be so small that the bending stress of the steel is exceeded.

Welds may be made at a rate of approximately one each one and a half minutes, so that the process is capable of producing up to 2.15 million feet per year. A single weld in 1 inch diameter round rod is believed to have a torsional strength of 2000 ft lbs, well above the 1000 ft lb torque commonly encountered in rod applications, though slightly below the failure strength of round rod without welds.

After use, the coils of rod may be moved to a new facility providing private roads are used.

Immaterial modifications may be made to the invention described here without departing from the essential characteristics of the invention.

The embodiments of the invention in which an exclusive property or privilege is claimed are defined as follows:

1. A method of preparing rod for injection into a well, the method comprising the steps of:

welding straight lengths of round bar end to end to form welded rod; and coiling the welded rod on a storage reel at a well site.

2. The method of claim 1 further comprising transporting straight lengths of round bar to the well site.

3. The method of claim 2 further comprising the step of preparing the straight lengths of round bar for welding at the well site.

4. The method of claim 3 in which preparing the straight lengths of round bar comprises pencil pointing the ends of the lengths of rod.

5. The method of claim 4 in which welding the straight lengths of round bar comprises MIG welding.

6. The method of claim 5 further comprising the step of grinding the welded rod.

7. The method of claim 6 further comprising the step of polishing the welded rod after grinding.

8. The method of claim 7 further comprising the step of torque testing the welded rod.

9. The method of claim 8 further comprising the step of coating the welded rod with a rust inhibitor after grinding and polishing.

10. The method of claim 9 in which each length of round bar is about 40 feet long.

11. The method of claim 3 further comprising the steps of:

grinding and then polishing the welded rod; and coating the grinded and polished welded rod with a rust inhibitor.

12. The method of claim 1 further comprising the step of grinding the welded rod.

13. The method of claim 1 further comprising the step of polishing the welded rod.

14. The method of claim 1 further comprising the step of torque testing the welded rod.

15. The method of claim 1 further comprising the step of coating the welded rod with a rust inhibitor.

* * * * *